US009592589B2

(12) United States Patent
Wang

(10) Patent No.: US 9,592,589 B2
(45) Date of Patent: Mar. 14, 2017

(54) ADJUSTABLE PLIER

(71) Applicants: HANGZHOU GREAT STAR TOOLS CO., LTD, Hangzhou (CN); HANGZHOU GREAT STAR INDUSTRIAL CO., LTD, Hangzhou (CN)

(72) Inventor: Min Wang, Hangzhou (CN)

(73) Assignees: HANGZHOU GREAT STAR TOOLS CO., LTD, Hangzhou (CN); HANGZHOU GREAT STAR INDUSTRIAL CO., LTD, Hangzhou (CN)

( * ) Notice: Subject to any disclaimer, the term of this patent is extended or adjusted under 35 U.S.C. 154(b) by 0 days.

(21) Appl. No.: 14/369,775

(22) PCT Filed: Dec. 6, 2013

(86) PCT No.: PCT/CN2013/088780

§ 371 (c)(1),
(2) Date: Jun. 30, 2014

(87) PCT Pub. No.: WO2014/114145

PCT Pub. Date: Jul. 31, 2014

(65) Prior Publication Data

US 2015/0336243 A1 Nov. 26, 2015

(30) Foreign Application Priority Data

Jan. 25, 2013 (CN) ..... 2013 2 0047726 U

(51) Int. Cl.
*B25B 7/10* (2006.01)

(52) U.S. Cl.
CPC ..... *B25B 7/10* (2013.01)

(58) Field of Classification Search
CPC ..... B25B 7/10
See application file for complete search history.

(56) References Cited

U.S. PATENT DOCUMENTS 5,351,584 A * 10/1994 Warheit ..... B25B 7/10 81/314
5,461,951 A 10/1995 Putsch
(Continued)

FOREIGN PATENT DOCUMENTS

CN 201455835 U 5/2010
CN 203077167 U 7/2013
(Continued)

*Primary Examiner* — David B Thomas
(74) *Attorney, Agent, or Firm* — Cantor Colburn LLP

(57) ABSTRACT

The present invention discloses a pair of adjustable pliers comprising a first handle having a first gripping part arranged at the front end thereof and a second handle having a second gripping part arranged at the front end thereof. The first gripping part and the second gripping part forms a jaw span, and the first handle and the second handle are arranged in an intersectional manner and relatively fixed via a connecting mechanism, characterized in that, the second handle is provided with an elongated rack slot at a position of the connecting mechanism and the rack slot is provided with a toothed rack on a inner side part thereof. The connecting mechanism comprises a toothed block and a link mechanism, the toothed block is arranged inside the rack slot and engaged with the toothed rack of the rack slot, and the link mechanism connects with the toothed block, drives the toothed block to rotate and disengages from the rack slot. Thus the first handle is able to move relative to the second handle along the rack slot through the movement of the connecting mechanisms, wherein, the teeth of the toothed rack are one-way ratchet teeth.

13 Claims, 6 Drawing Sheets

(56) References Cited

U.S. PATENT DOCUMENTS

| | | | | |
|---|---|---|---|---|
| 5,845,551 | A | 12/1998 | Putsch | |
| 5,887,495 | A * | 3/1999 | Kao | B25B 7/10 81/358 |
| 6,199,459 | B1 | 3/2001 | Azkona | |
| 6,467,380 | B1 * | 10/2002 | Azkona | B25B 7/12 81/357 |
| 6,502,482 | B1 * | 1/2003 | Putsch | B25B 7/10 81/358 |
| 6,892,609 | B2 * | 5/2005 | Kuo | B25B 7/10 81/409.5 |
| 7,255,027 | B1 * | 8/2007 | Tsai | B25B 7/10 81/357 |
| 7,406,898 | B1 | 8/2008 | Hall | |
| 2012/0111157 | A1 | 5/2012 | Qiu | |

FOREIGN PATENT DOCUMENTS

| | | | |
|---|---|---|---|
| EP | 2149427 | A1 | 2/2010 |
| GB | 1265295 | | 3/1972 |
| JP | 3073927 | A | 12/2000 |

* cited by examiner

ADJUSTABLE PLIER

FIELD OF THE INVENTION

The present invention relates to a pair of pliers, more precisely relates to pliers with a jaw opening which can be adjusted quickly.

DESCRIPTION OF THE PRIOR ART

Traditional pliers have two intersecting plier arms which are rotationally connected to each other by a pivot in the region of intersection for gripping objects. Jaws for gripping objects are formed above the intersection region and handles for holding are below the intersection region. However, the open size of the jaws is fixed, so the size range of the gripped objects is limited.

Therefore, U.S. Pat. No. 5,845,551 discloses a pair of pliers with an adjustable jaw opening, wherein one plier arm has a slot in the intersection region and the slot is profiled on its slot flanks, the profiling being a saw-tooth profiling. The other plier arm is displaceable stepwise along the teeth, and can be fixed to each tooth; thus the span between the jaws can be adjusted.

However, the adjustment of the pliers is both-way, which is to say that the pivot in the intersection region has an adjusting switch. When the switch is on, the two plier arms can move relatively and when the switch is off, the position of the two plier arms are fixed relatively to be used. The drawback of this design is inconvenience in use. In using, first turn on the switch, and keep it on, then enlarge the span between the jaws to being larger than the size of the object, and then narrow the span gradually to the exact size of the object to grip it. Both processes of enlarging and narrowing the span require keeping the switch on to adjust the span between the jaws. Therefore, it is very inconvenient for users, so further improvement is needed in order that not only holding the switch all the time is no more required, but also the design of the switch is more simple and convenient.

SUMMARY OF THE INVENTION

The objective of the present invention is providing a pair of pliers, wherein only one-way adjustment of the jaw opening needs a switch to control while the adjustment in the other way does not need any switch, thus stabilizing the plier jaws on the object to be gripped.

Another objective of the present invention is providing a pair of pliers with an adjustable jaw opening, wherein the adjusting switch is designed simple and convenient to use.

To realize the above objectives, the present invention provides a pair of adjustable pliers comprising a first handle having a first gripping part arranged at a front end thereof and a second handle having a second gripping part arranged at a front end thereof, the first gripping part and the second gripping part forming a jaw span, the first handle and the second handle being arranged in an intersectional manner and relatively fixed via a connecting mechanism, characterized in that the second handle is provided with an elongated rack slot at a position of the connecting mechanism, and the rack slot is provided with a toothed rack on a inner side part thereof. The connecting mechanism comprises a toothed block and a link mechanism, the toothed block is arranged inside the rack slot and engaged with the toothed rack of the rack slot, and the link mechanism connects with the toothed block, drives the toothed block to rotate and disengages from the rack slot. Thus the first handle is able to move relative to the second handle along the rack slot through the movement of the connecting mechanisms.

The teeth of the toothed rack are one-way ratchet teeth.

The link mechanism comprises a pivot and a trigger mechanism, the pivot is arranged in a through-hole of the toothed block and rotationally connects with the toothed block, and the trigger mechanism connects with the pivot. The trigger mechanism drives the pivot to rotate, and the pivot further drives the toothed block to rotate.

A lateral wall of the first handle is provided with a lateral hole at a position of the connecting mechanism, and the lateral hole allows a corresponding position of the second handle to pass through, forming a first part of the first handle over the second handle and a second part of the first handle beneath the second handle; wherein the pivot passes through the first part of the first handle, and then passes through the rack slot of the second handle, and further passes through the second part of the first handle.

A opposite side of teeth of toothed block engaging with rack slot is provided with a fixing part and an elastic piece, wherein the elastic piece is connected to the fixing part and propped against the second handle.

The fixing part is a spring hole, and the elastic piece is a spring, wherein the spring is arranged inside the spring hole.

The first gripping part and the second gripping part are both hook-like, and teeth are arranged on the edges of the inside thereof to facilitate gripping and engaging.

The first gripping part or the second gripping part and the first handle or the second handle are capable of integrating or connecting together via connecting means.

The trigger mechanism comprises a shifter mounted on the pivot and arranged on a outer side of the first part of the first handle.

A shape of a cross-section of the through-hole of the toothed block is a notched circular, and the toothed block is sheathed on the pivot. The other end of the pivot is fixed to the shifter.

The connection between the toothed block and the pivot in the through-hole is a splined connection.

The shifter is provided with a second through-hole, a shape of a cross-section of the second through-hole is a notched circular, and the shifter is sheathed on the pivot.

The shifter is provided with a projection.

In another embodiment, a outside of the pivot is provided with a spiral second groove with a guiding pin in it, and a other end of the guiding pin extends into the toothed block through a lateral part, the trigger mechanism further comprises a trigger switch, and when the trigger switch produces a downward force, the guiding pin rotates along the spiral second groove to drive the toothed block to rotate.

The trigger mechanism further comprises a toothed ring and a spring, the toothed ring is provided with internal teeth and is fixedly arranged inside a depression of the outer side of the first part of the first handle, and the spring is arranged beneath the trigger switch and inside the toothed ring.

DETAILED DESCRIPTION OF THE PREFERRED EMBODIMENTS

Figure 1:
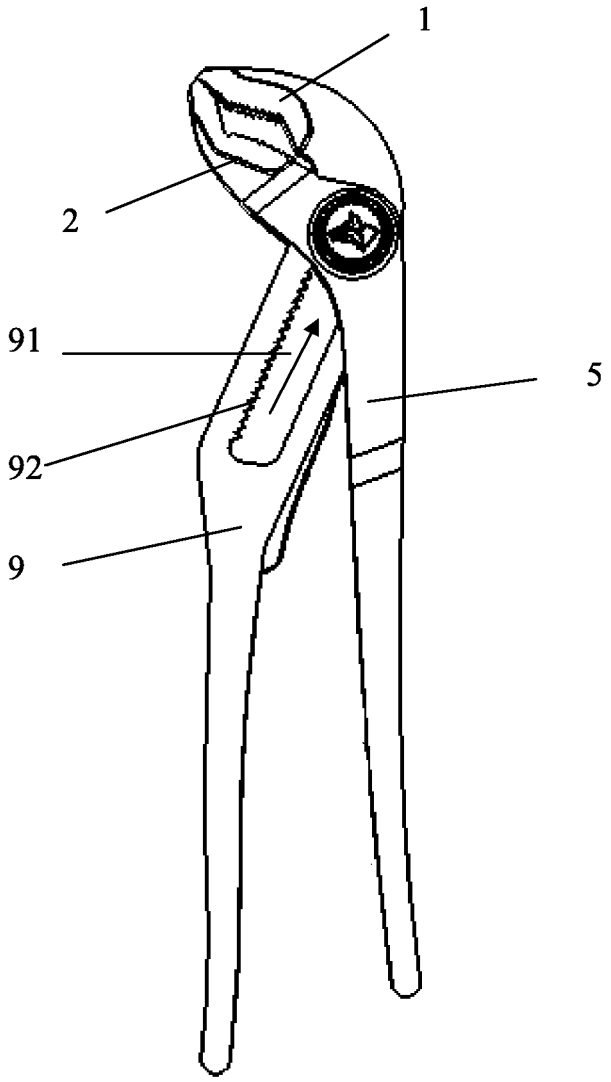
FIG. 1 is a schematic diagram according to a preferable embodiment of the present invention.
Figure 2:
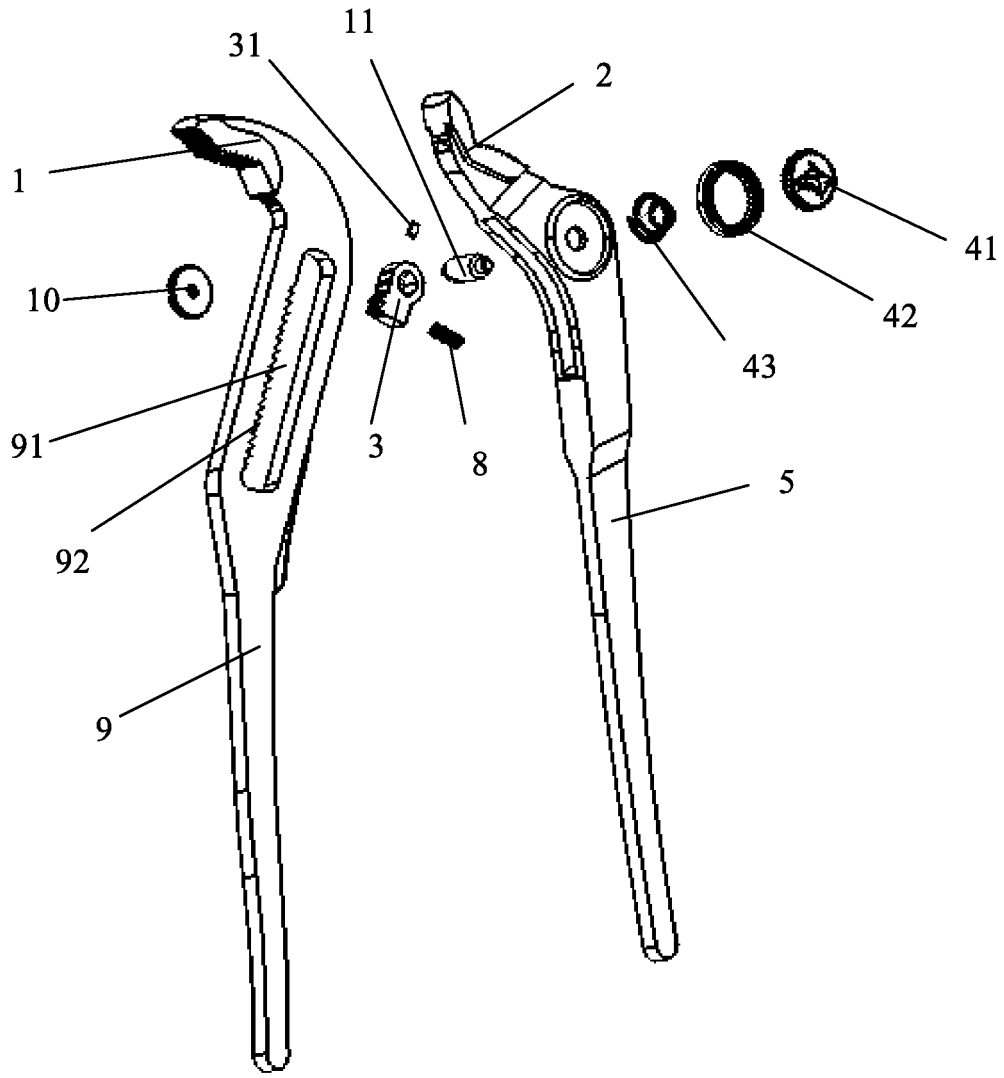
FIG. 2 is an exploded view according to a preferable embodiment of the present invention.
Figure 3:
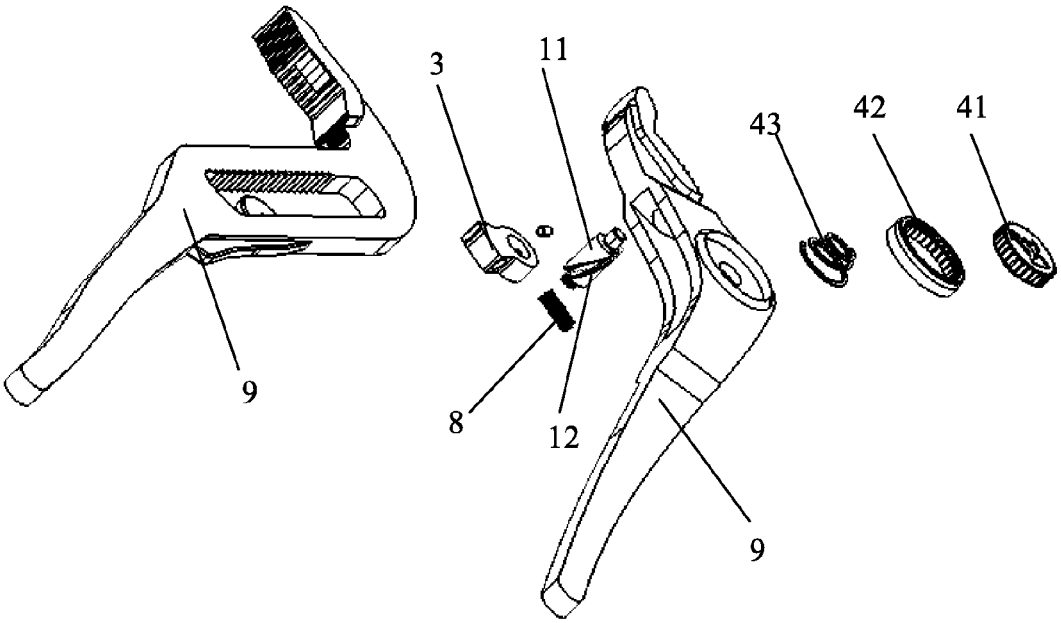
FIG. 3 is an exploded view of another perspective according to a preferable embodiment of the present invention.
Figure 4:
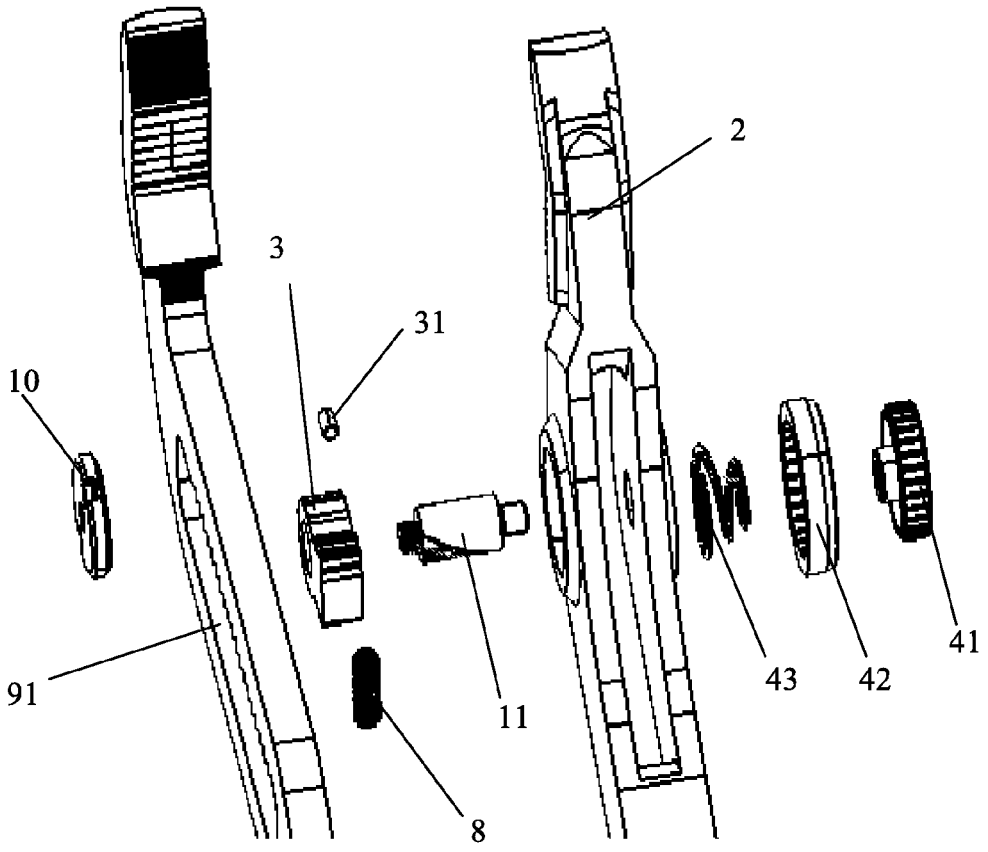
FIG. 4 is a local enlarging exploded view according to a preferable embodiment of the present invention.

As shown in FIGS. 1-6, a pair of adjustable pliers comprises a first handle 5 having a first gripping part 2 arranged at the front end thereof and a second handle 9 having a second gripping part 1 arranged at the front end thereof. The first gripping part 2 and the second gripping part 1 form a jaw span, and the first handle and the second handle are arranged in an intersecting manner and relatively fixed via a connecting mechanism, wherein the second handle is provided with an elongated rack slot 91 in the region of the connecting mechanism and the rack slot 91 is provided with a toothed rack 92 on its inside flank. The connecting mechanism comprises a toothed block 3, which is arranged inside the rack slot 91 and engaged with the toothed rack 92 of the rack slot 91, and a link mechanism connected with the toothed block 3 to drive it to rotate and disengage from the rack slot 91. Thus the first handle 5 is able to move relative to the second handle 9 along the rack slot 91 through the movement of the connecting mechanisms to change the size of the opening, wherein the teeth of the toothed rack are one-way ratchet teeth, i.e. the teeth are all oblique toward one direction, inclining toward the direction of the arrow inside the rack slot as shown in FIG. 1. In this way, when a force is exerted in a direction opposite to the inclining teeth, i.e. the opposite direction of the arrow, due to the barbs between the toothed rack and the toothed block, an external force is required to separate them to enable the toothed block to slide in the rack slot. While in the inclining direction of the teeth, i.e. the direction of the arrow, the toothed rack can drive the toothed block to overcome the elastic force and automatically disengage from the teeth of the toothed rack without any external force, and thus realizing quick one-way sliding.

Specifically, the meaning of one-way ratchet teeth is that the teeth of the toothed rack extend obliquely upward from the edge of the slot, inclining toward the arrow direction inside the rack slot as shown in FIG. 1. When the opening is needed to be enlarged, i.e. the first handle is pulled down from the top of the rack slot (i.e. moving toward the opposite direction of the arrow), a trigger member is needed to disengage the toothed block from the toothed rack, and when the first handle is pulled up from the lower part of the rack slot (i.e. moving toward the direction of the arrow), because of the one-way ratchet teeth, even if the toothed block and toothed rack are in engagement, the toothed block still can move along the rack slot freely. Thus, in the enlarged status of the opening, put the object in the mouth, and then shrink the opening just to match the size of the object to grip it.

The adjustable pliers can be water pump pliers, pipe pliers or other pliers, wherein both of the gripping parts are hook-like, and teeth are arranged on the edges of the inside flank thereof to facilitate gripping and engaging. The gripping parts can be integrated with the handles, or can be connected to the handles via connecting means as well.

The position of the first handle 5 and that of the link mechanism is relatively fixed. The link mechanism comprises a pivot 11 which is arranged in the through-hole of the toothed block 3, and a trigger mechanism which is connected with the pivot. The trigger mechanism drives the pivot to rotate, and the pivot further drives the toothed block to rotate, thus disengaging the toothed block from the toothed rack and making the relative movement become possible.

The first handle 5 is provided with a first through-hole in the region of the pivot, the pivot being cylindrical and its cross-section being circular; and the pivot passes through the first through-hole and then passes through the rack slot of the second handle 9 to relatively fix the first handle 5 and the second handle 9.

More specially, the first handle is provided with a lateral hole in its lateral wall in the region of the connecting mechanism, which allows the corresponding region of the second handle to pass through, forming a first part of the first handle over the second handle and a second part of the first handle beneath the second handle; wherein the pivot passes through the first part of the first handle, and then through the rack slot of the second handle, and further through the second part of the first handle. The toothed block is located inside the rack slot engaging with the rack slot.

One flank of the toothed block is provided with teeth which can engage with the toothed rack, and the other flank is provided with a fixing part and an elastic piece, wherein the elastic piece is connected to the fixing part and propped against the second handle. Specially, the fixing part can be a spring hole, and the elastic piece is concretely a spring 8, and the spring is arranged inside the spring hole propped against the second handle. Accordingly, after releasing the trigger member, the teeth of the toothed block can recover to the status of the engagement with the teeth of the toothed rack due to the effect of the spring, thus the pliers can be normally used.

Figure 5:
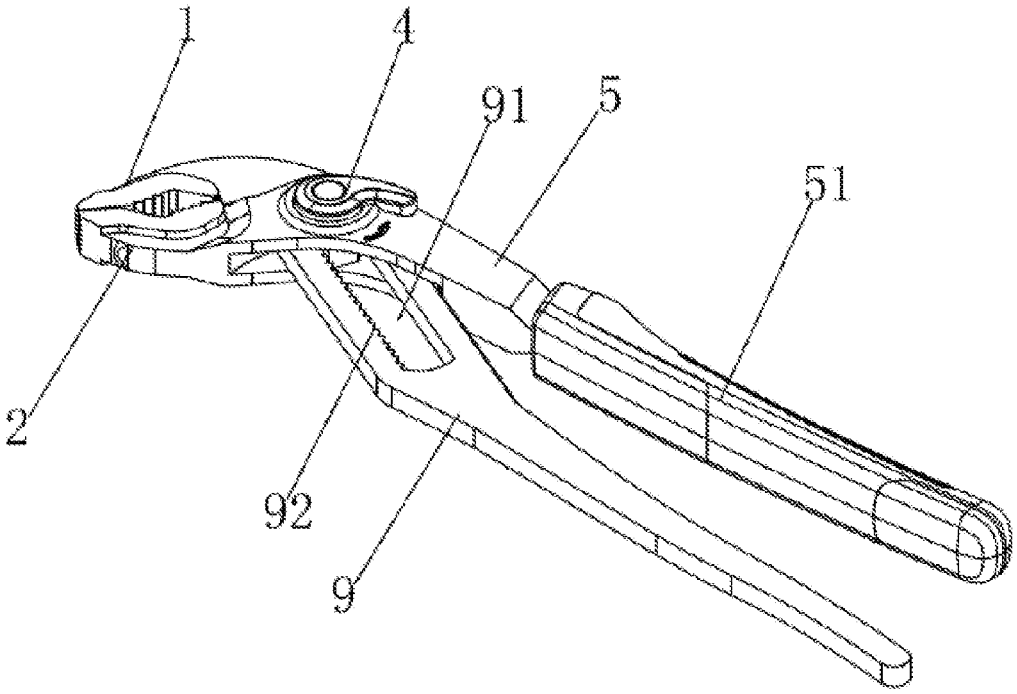
FIG. 5 is a schematic diagram according to another preferable embodiment of the present invention.
Figure 6:
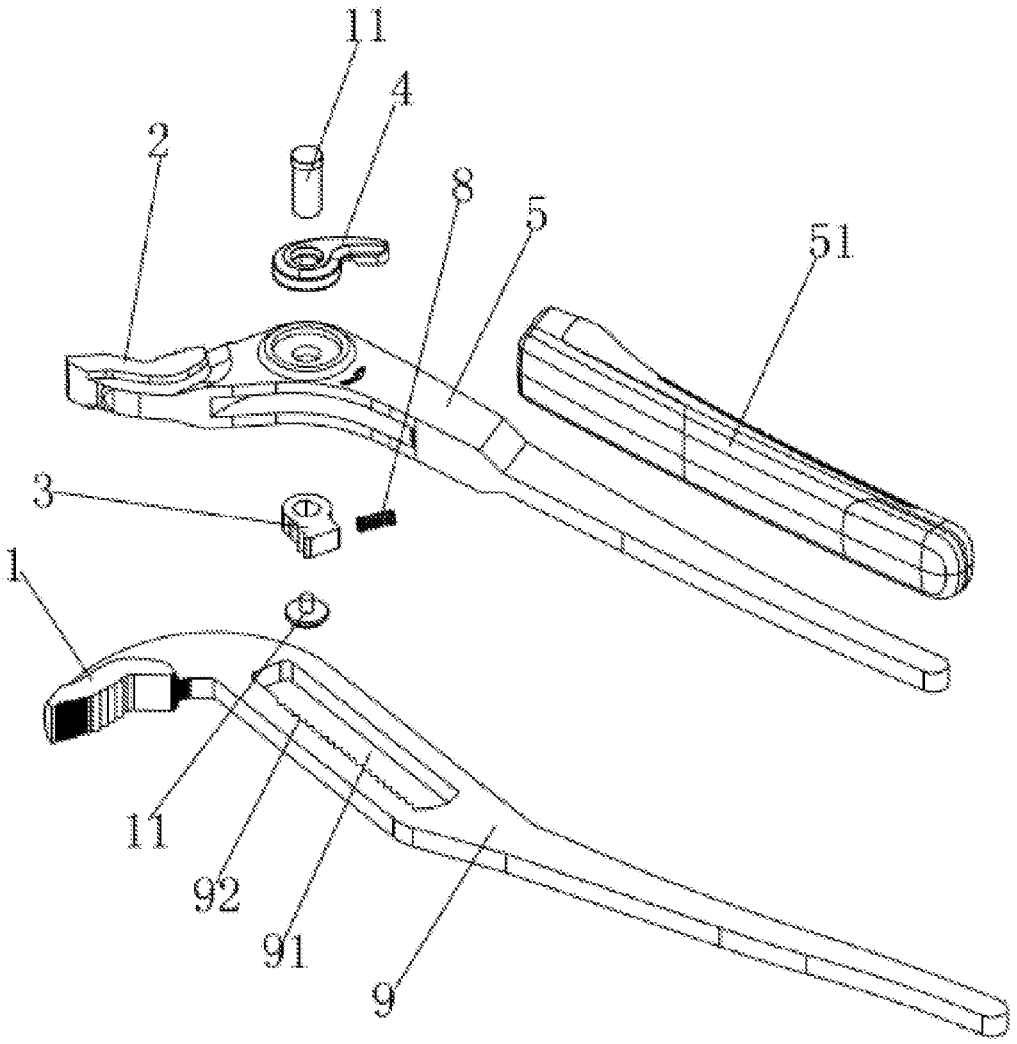
FIG. 6 is an exploded view according to another preferable embodiment of the present invention.

As shown in FIGS. 5-6, the trigger mechanism comprises a shifter 4 also mounted on the pivot and arranged on the outer side of the first part of the first handle. After stirring the shifter, the pivot generates the effect of rotation, thus driving the toothed block to rotate and disengage from the toothed rack. Accordingly, the first handle and the second handle can relatively move along the rack slot.

Specially, the cross-section shape of the through-hole of the toothed block 3 is a notched circular, and the toothed block is sheathed on the pivot 11, so the toothed block can rotate together with the pivot. The rotary connection between the toothed block and the pivot can also be designed in other forms, such as splined connection; the notch or notches can be arranged on either side or both sides; and the function can be realized as long as one rotation drives the other rotation. The other end of the pivot is fixed to the shifter 4, and the pivot can rotate along with the rotation of the shifter. In detail, the shifter can be provided with a through-hole, and the cross-section shape of the through-hole is a notched circular, and the shifter is sheathed on the pivot, so the shifter can drive the pivot to rotate. Similarly, the connection between the shifter and the pivot can also be designed in other forms, such as splined connection, the notch or notched can be arranged on either side or both sides; and the function can be realized as long as one rotation drives the other rotation. The end of the pivot outside the shifter is provided with an enlarged area of cross-section, thus fixing the shifter on the pivot. The shifter also is provided with a projection to facilitate the manual operation of rotation.

The pivot is provided with a wider head outside the trigger member which is on the first part of the first handle over the second handle, thus the pivot can be fixed to the trigger member outside the first handle. While the other end of the pivot, i.e. beneath the outer side of the second part of the first handle, is fixed via a fixing member 10. The other end of the pivot can be a thread and the fixing member 10 can be a nut, and accordingly, the pivot can be fixed by turning the thread into the nut.

In another embodiment, as shown in FIGS. 1-4, the outside of the pivot 11 is provided with a spiral second groove 12 with a guiding pin 31 in it, and the other end of the guiding pin extends into the toothed block through the lateral part. The trigger mechanism also comprises a trigger switch 41, after the trigger switch produces a downward force, the guiding pin 31 starts to rotate along the spiral second groove 12, which drives the toothed block 3 to rotate and disengage from the rack slot, thus the first handle can move along the rack slot relative to the second handle.

The trigger mechanism also comprises a toothed ring 42 and a spring 43; the toothed ring is provided with internal teeth and is fixedly arranged inside the depression of the outer side of the first part of the first handle; the spring is arranged inside the toothed ring beneath the trigger switch and inside the depression of outer side of the first part of the first handle. The trigger switch is provided with external teeth which can engage with the internal teeth of the toothed ring. Normally, the trigger switch and the toothed ring are separated; with the effect of the spring the trigger switch is jacked up by the spring and the external teeth of the trigger switch are separated from the internal teeth of the toothed ring. After the trigger switch is pressed, the external teeth of the trigger switch go inside the internal teeth of the toothed ring; because the toothed ring is fixed, after the internal teeth of the toothed ring engage with the external teeth of the trigger switch, the trigger switch stops rotating and the guiding pin 31 starts to rotate along the spiral second groove 12, thus driving the toothed block 3 to rotate. The inner diameter of the spring decreases gradually from the bottom to the direction of the trigger switch, the bottom is arranged inside the toothed ring 42, which is inside the depression of the first part of the first handle, and the top is in contact with the bottom of the trigger member.

The pivot is provided with a smaller head outside the trigger member which is on the first part of the first handle over the second handle, thus the pivot can be fixed inside the trigger member outside the first handle. While the other end of the pivot, i.e. beneath the outer side of the second part of the first handle, is fixed via a fixing member 10. The other end of the pivot can be a thread and the fixing member 10 can be a nut, and accordingly, the pivot can be fixed by turning the thread into the nut.

In a complete embodiment, as shown in FIGS. 5-6, a pair of pipe pliers comprise an upper handle, i.e. the first handle 5, and the a lower handle, i.e. the second handle 9, the front end of the lower handle is arranged with a first gripping part 1, designated upper jaw, which is hook-like, the front end of the upper handle is arranged with a second gripping part 2, designated lower jaw, which is also hook-like. The lower jaw can be integrated with the upper handle or be arranged separately and fixed to the upper handle via a fixing element. The lower handle passes through the upper handle, and a through-slot is arranged in the upper handle, i.e. preceding lateral hole. After the lower handle passes through the through-slot, an intersection is formed, and a mouth is formed by the upper jaw and the lower jaw. A rack slot 91 is arranged on the lower handle, and a toothed rack 92 is arranged on the inside flank of the rack slot 91. A toothed block 3, which is hinged to the upper handle, is provided with teeth on one flank thereof, engaging with the toothed rack 92 and being able to move in one-way along the toothed rack. The other flank of the toothed block 3 is propped against a spring 8, and the spring 8 is propped against the lower handle. A shifter 4, which is hinged to the toothed block, is arranged on the upper handle. A spring hole is arranged in the toothed block 3, and the spring 8 is arranged therein, thus making the fixation of the spring 8 more stable; the shifter is hinged to the toothed block 3 and the upper handle via a screw, i.e. preceding pivot 11 and fixing member 10 thereof. The upper handle is sleeved with a plastic cover 51 to make the holding part more comfortable and beautiful.

During the using of the pipe pliers, if the two jaws are too close, an adjustment to enlarge the span between the upper jaw and the lower jaw is required. At this time, first stir the shifter, and the shifter drives the toothed block 3 to rotate and disengage with the toothed rack 92 of the toothed slot 91, and thus the upper handle can slide down along the toothed slot of the lower handle. Then bite the bolt to be wrenched with the upper jaw, and slide the upper handle up along the toothed slot to tighten; since the teeth of the toothed block 3 can smoothly slide up along the toothed rack 92, the upper handle can go up with the lower jaw all the way to join the upper jaw until the bolt is bitten tightly by the upper jaw and the lower jaw. Then tightly hold the upper handle and the lower handle, and wrench the handles to operate. When the shifter is loosened, the spring 8 will press the teeth on the flank of the toothed block 3 to the toothed rack 92, since the toothed block cannot move down along the toothed rack, even if the handles are loosened slightly, the upper handle will not slide down automatically, and the upper jaw and the lower jaw will still tightly bite the bolt. While it is needed to separate the two jaws, just stir the shifter to disengage the toothed block from the toothed rack.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A pair of adjustable pliers, comprising a first handle having a first gripping part arranged at a front end thereof and a second handle having a second gripping part arranged at a front end thereof, the first gripping part and the second gripping part forming a jaw span, the first handle and the second handle being arranged in an intersectional manner and relatively fixed via a connecting mechanism, characterized in that the second handle is provided with an elongated rack slot at a position of the connecting mechanism, and the rack slot is provided with a toothed rack on an inner side part thereof; the connecting mechanism comprises a toothed block and a link mechanism, the toothed block is arranged inside the rack slot and engaged with the toothed rack of the rack slot, and the link mechanism connects with the toothed block, drives the toothed block to rotate and disengages from the rack slot; thus the first handle is able to move relative to the second handle along the rack slot through the movement of the connecting mechanism, wherein teeth of the toothed rack are one-way ratchet teeth, the link mechanism comprises a pivot and a trigger mechanism, the pivot is arranged in a through-hole of the toothed block and rotationally connects with the toothed block, and the trigger mechanism connects with the pivot; the trigger mechanism drives the pivot to rotate, and the pivot further drives the toothed block to rotate.

2. The pair of adjustable pliers according to claim 1, characterized in that a lateral wall of the first handle is provided with a lateral hole at a position of the connecting mechanism, and the lateral hole allows a corresponding position of the second handle to pass through, forming a first part of the first handle over the second handle and a second part of the first handle beneath the second handle; wherein the pivot passes through the first part of the first handle, and then passes through the rack slot of the second handle, and further passes through the second part of the first handle.

3. The pair of adjustable pliers according to claim 2, characterized in that a opposite side of teeth of toothed block engaging with rack slot is provided with a fixing part and an elastic piece, wherein the elastic piece is connected to the fixing part and propped against the second handle.

4. The pair of adjustable pliers according to claim 3, characterized in that the fixing part is a spring hole, and the elastic piece is a spring, wherein the spring is arranged inside the spring hole.

5. The pair of adjustable pliers according to claim 4, characterized in that the first gripping part and the second gripping part are both hook-like, and teeth are arranged on the edges of the inside thereof to facilitate gripping and engaging.

6. The pair of adjustable pliers according to claim 5, characterized in that the first gripping part or the second gripping part and the first handle or the second handle are capable of integrating or connecting together via connecting means.

7. The pair of adjustable pliers according to claim 2, characterized in that the trigger mechanism comprises a shifter mounted on the pivot and arranged on a outer side of the first part of the first handle.

8. The pair of adjustable pliers according to claim 7, characterized in that a shape of a cross-section of the through-hole of the toothed block is a notched circular, the toothed block is sheathed on the pivot, and a other end of the pivot is fixed to the shifter.

9. The pair of adjustable pliers according to claim 8, characterized in that the shifter is provided with a second through-hole, a shape of a cross-section of the second through-hole is a notched circular, and the shifter is sheathed on the pivot.

10. The pair of adjustable pliers according to claim 9, characterized in that the shifter is provided with a projection.

11. The pair of adjustable pliers according to claim 7, characterized in that a connection between the toothed block and the pivot in the through-hole is a splined connection, and the other end of the pivot is fixed to the shifter.

12. The pair of adjustable pliers according to claim 1, characterized in that a outside of the pivot is provided with a spiral second groove with a guiding pin in it, and, a other end of the guiding pin extends into the toothed block through a lateral part; the trigger mechanism further comprises a trigger switch, and when the trigger switch produces a downward force, the guiding pin rotates along the spiral second groove to drive the toothed block to rotate.

13. The pair of adjustable pliers according to claim 12, characterized in that the trigger mechanism further comprises a toothed ring and a spring, the toothed ring is provided with internal teeth and is fixedly arranged inside a depression of the outer side of the first part of the first handle, and the spring is arranged beneath the trigger switch and inside the toothed ring.

* * * * *